US005975477A

United States Patent [19]

Spitler

[11] Patent Number: 5,975,477

[45] Date of Patent: Nov. 2, 1999

[54] RIGID LIGHT FIXTURE MOUNTING BRACKET

[76] Inventor: Brian L. Spitler, 108 Avenue of Trees, Elon College, N.C. 27244

[21] Appl. No.: 08/956,978

[22] Filed: Oct. 23, 1997

[51] Int. Cl.[6] ..... B42F 13/00; A47F 5/00; F21V 7/20

[52] U.S. Cl. ..... 248/342; 248/343; 248/300; 362/345

[58] Field of Search ..... 248/342, 343, 248/300; 362/147, 362, 364, 365, 345

[56] References Cited

U.S. PATENT DOCUMENTS

| | | | |
|---|---|---|---|
| 4,595,971 | 6/1986 | Dean | 362/345 |
| 4,905,132 | 2/1990 | Singarayar et al. | 362/294 |
| 5,379,195 | 1/1995 | Epstein | 362/20 |
| 5,662,407 | 9/1997 | Fischer et al. | 362/147 |
| 5,853,159 | 12/1998 | Gorini et al. | 248/674 |

*Primary Examiner*—Derek J. Berger
*Assistant Examiner*—David Heisey
*Attorney, Agent, or Firm*—Niro, Scavone, Haller & Niro

[57] ABSTRACT

A rigid support bracket mounts a transformer to an electrical light fixture. The bracket is formed with end portions adapted to receive fasteners therethrough for mounting the bracket to the electrical fixture. The rigid support bracket resists undesired shifting or bending of the bracket before and during transformer installation, thus providing easy and quick installation of a transformer to a light fixture.

4 Claims, 4 Drawing Sheets

RIGID LIGHT FIXTURE MOUNTING BRACKET

BACKGROUND OF THE INVENTION

1. Field of Invention

This invention relates generally to a support device for supporting a transformer within a light fixture and more specifically to a rigid light fixture mounting bracket that fits within a light fixture.

2. Description of the Related Art

Transformers are used to magnetically couple alternating current voltages from one point in a circuit to another, or to increase or decrease the alternating current voltage. Transformers are generally mounted within fixtures so that they will not shift during operation and touch other conducting or grounded devices which could damage the transformers and fixtures.

Traditionally, in order to prevent shifting of a fixture enclosed transformer, the transformer has been affixed to a mounting bracket or the like which mounts the transformer to the fixture and prevents the transformer from shifting during operation. More recently, transformers have been mounted inside small fixtures. Therefore, the mounting bracket must also be adapted to fit inside any of various types of small fixture, each of which typically requires a mounting bracket having a shape that conforms to the particular structural configuration of a particular fixture. For example, FIG. 1 shows a prior art light fixture P comprising a upper light fixture housing 10, transformer 12, transformer mounting bracket 14, light bulb socket 16, and a lower lamp housing 18. Transformer mounting bracket 14 is typically formed of a material such as a steel strip which is capable of being bent into the particular shape that will fit within the particular relatively small upper light fixture housing 10 in which the bracket is installed. As shown in FIG. 2, the bottom surface of the transformer 12 is attached to the top surface of transformer mounting bracket 14. Additionally, FIG. 2 shows in further detail a typical shape of a prior art transformer mounting bracket 14 designed to fit the type of light fixture seen in FIG. 1.

Referring further to FIG. 1, transformer mounting bracket 14 is attached to fixture housing 10 by aligning transformer mounting bracket apertures 20 with mating apertures (not shown) of fixture housing 10 and attaching them together with fasteners, such as screws. Additionally, the lower lamp housing 18 is attached to the transformer mounting bracket 14 by aligning lens first bracket member apertures 22 with lower lamp housing apertures 24 and attaching them together with screws.

It is critical that the transformer mounting bracket screw receiving apertures 20 correctly align with the corresponding apertures of the fixture housing. A major problem with the prior art transformer mounting device is that the traditional transformer mounting bracket is formed of a material that can bend and otherwise contort before, during, or after installation. Relatively heavy transformers increase stress on their corresponding mounting brackets and, thus, typically bend the mounting bracket from its initial preferred shape. If the mounting bracket is bent from its original positioning alignment, its apertures will not align with the screw receiving apertures of the fixture housing. Furthermore, the lens mounting bracket apertures may not properly align with the apertures of the lower lamp housing, making it difficult to attach the lower lamp housing to the fixture housing. Bending of the transformer mounting bracket from its original preferred shape, causes an installer of such a fixture much aggravation as he or she tries to bend the bracket to its preferred shape, thereby possibly causing damage to the fixture, transformer, and the lower lamp housing.

It is therefore an object of this invention to provide a support brace for a transformer mounting bracket, which, when permanently attached thereto, prevents the resulting rigid light fixture mounting bracket of the invention from bending from its desired form.

It is another object of this invention to provide a rigid light fixture mounting bracket to make installation of transformers into light fixtures quick and easy.

It is a further object of this invention to provide a rigid light fixture mounting bracket which is inexpensive and durable.

Other objects will become apparent as the description proceeds.

SUMMARY OF THE INVENTION

In the preferred embodiment, the traditional transformer bracket is reinforced by the support brace of the invention which comprises a rectangular strip of metal shaped near each end portion so as to form a bridge-like structure. The support brace has a top and bottom surface and a screw receiving aperture at each end. The support brace of the invention spans the traditional transformer mounting bracket and is permanently affixed thereto. A transformer is permanently mounted to the top surface of the support brace. The support brace of the invention when used in combination with the traditional transformer mounting bracket forms a highly rigid light fixture mounting bracket that will not bend prior to or during normal installation, and further prevents the attached transformer from shifting during operation. The rigid light fixture mounting bracket of the invention furthermore provides for quick and easy fixture assembly.

DETAILED DESCRIPTION OF THE INVENTION AND PREFERRED EMBODIMENT THEREOF

Figure 1:
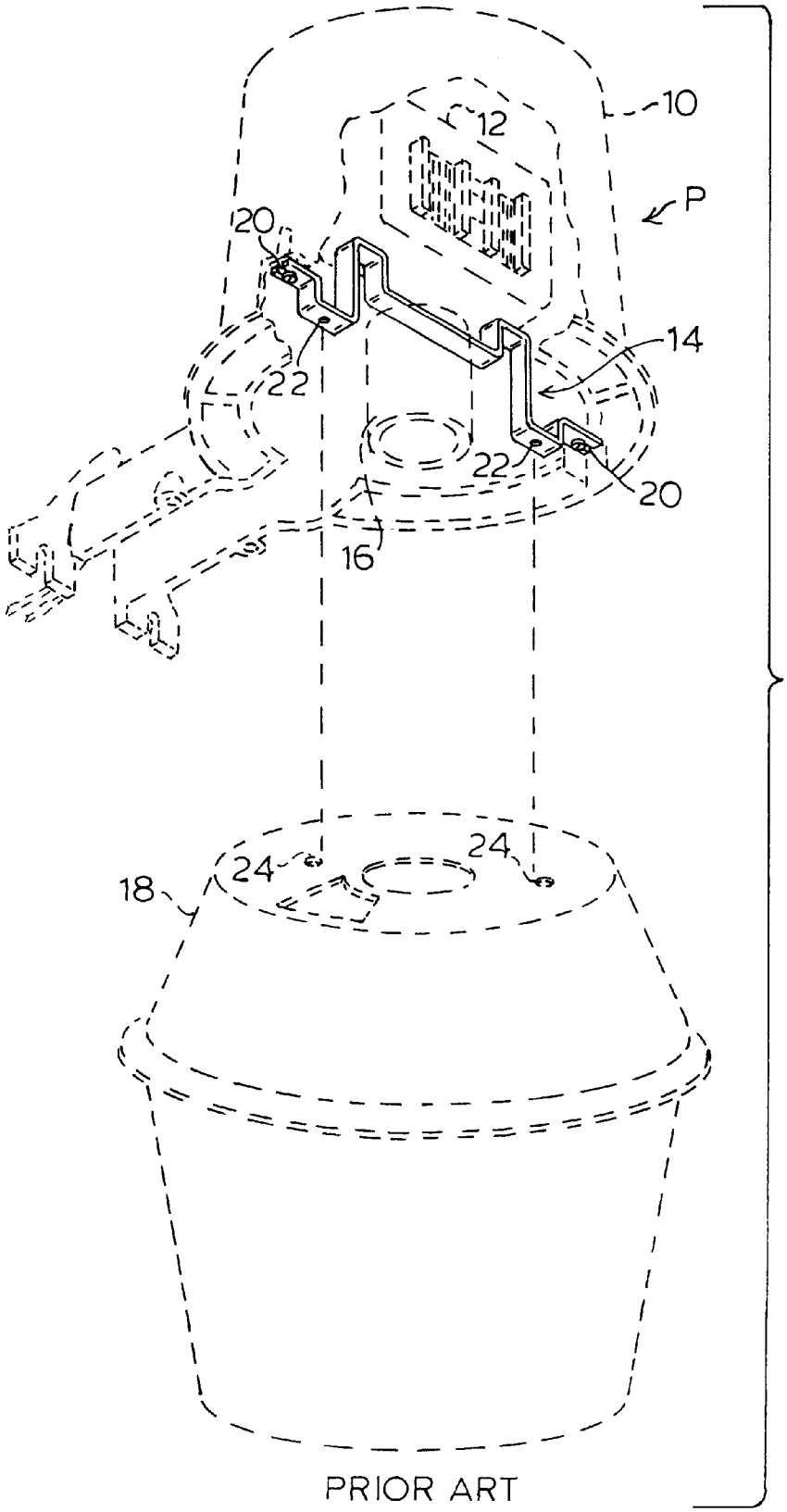
FIG. 1 is a perspective view of a prior art light fixture showing a prior art transformer mounting bracket and transformer mounted thereto, the light fixture and transformer are shown in dotted lines.
Figure 2:
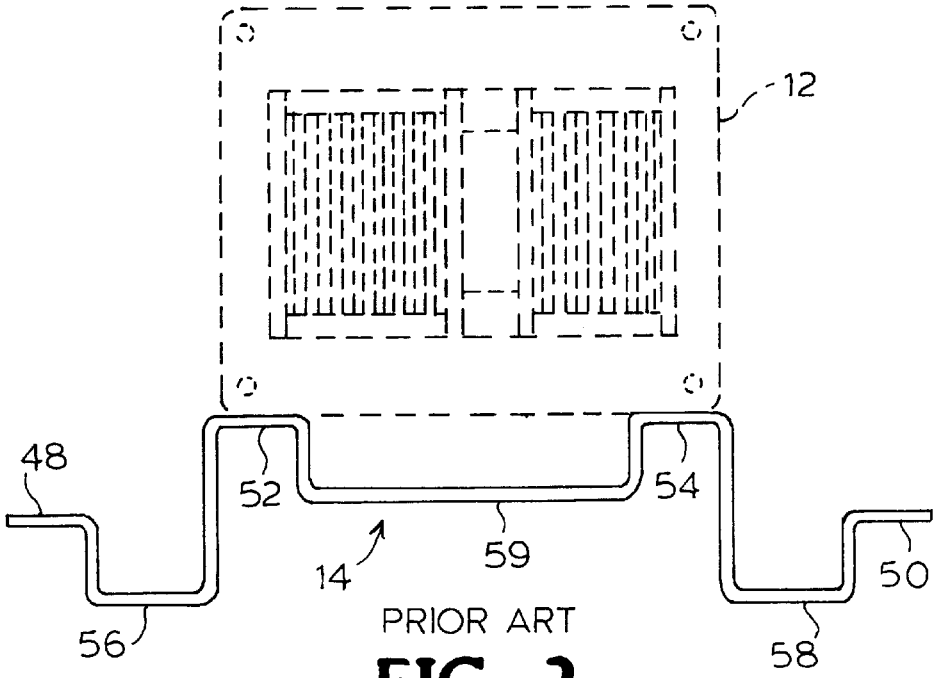
PRIOR ART FIG. 2
FIG. 2 is a side view of the transformer and prior art transformer mounting bracket shown in FIG. 1, the transformer is shown in dotted lines.
Figure 4:
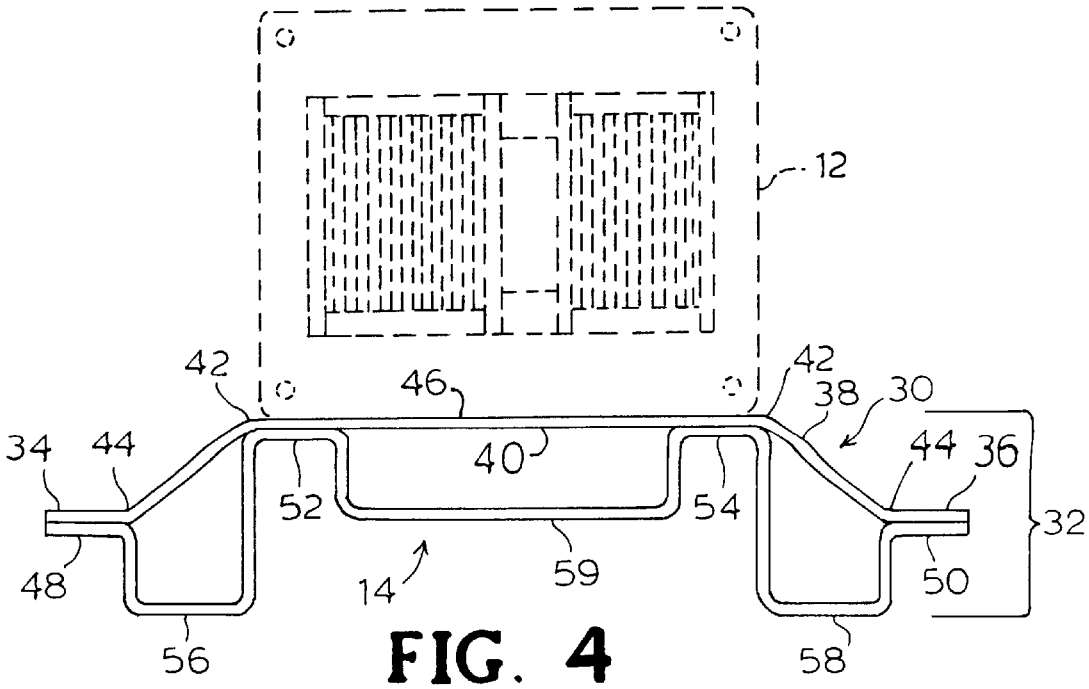
FIG. 4 is a side view of the rigid light fixture mounting bracket of the invention, the transformer is shown in dotted lines.
Figure 3:
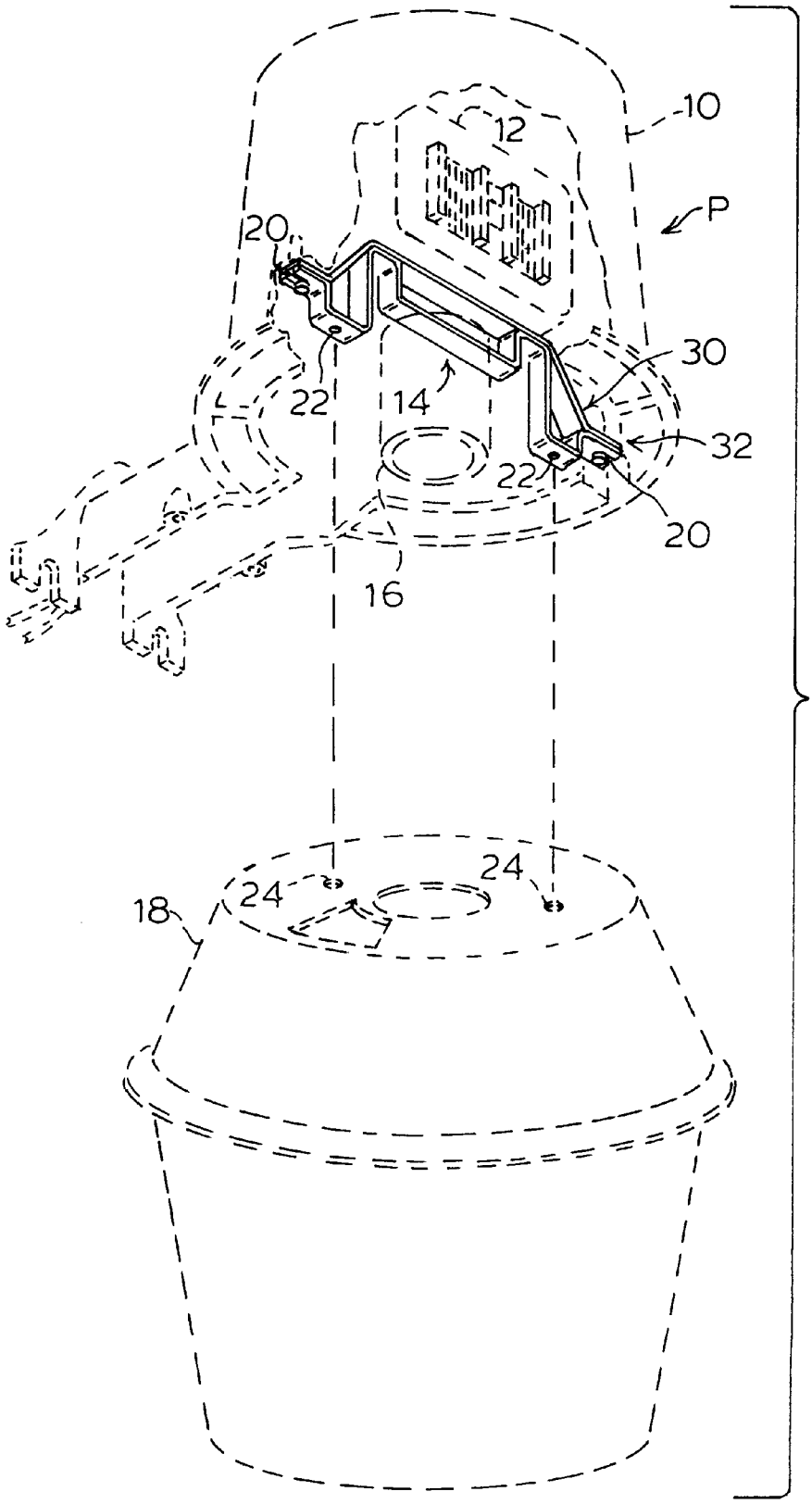
FIG. 3 is a perspective view of the light fixture of FIG. 1 equipped with the rigid support brace of the invention, the light fixture and transformer are shown in dotted lines.
Figure 5:
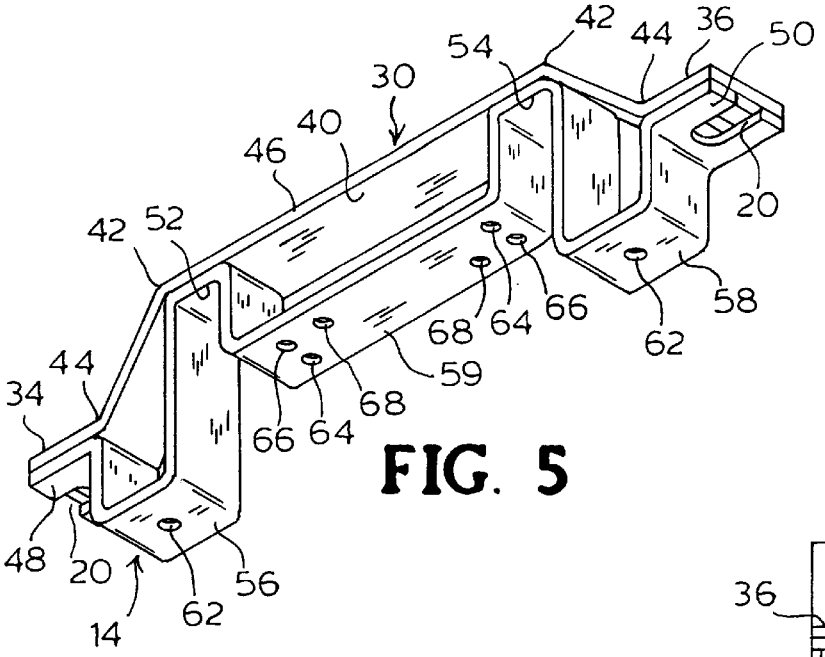
FIG. 5 is a bottom perspective view of the rigid light fixture mounting bracket of the invention.
Figure 7:
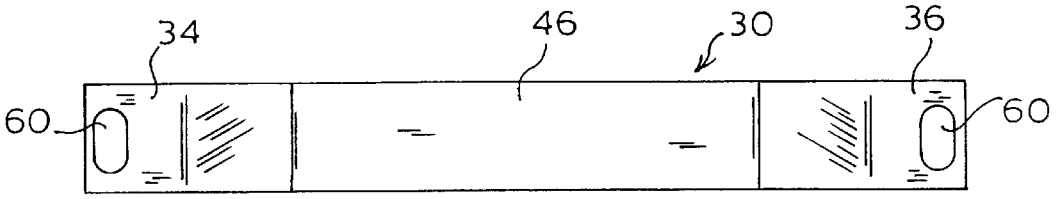
FIG. 7 is a top view of the rigid light fixture mounting bracket of the invention showing in particular a top view of the support brace shown in FIG. 5.
Figure 8:
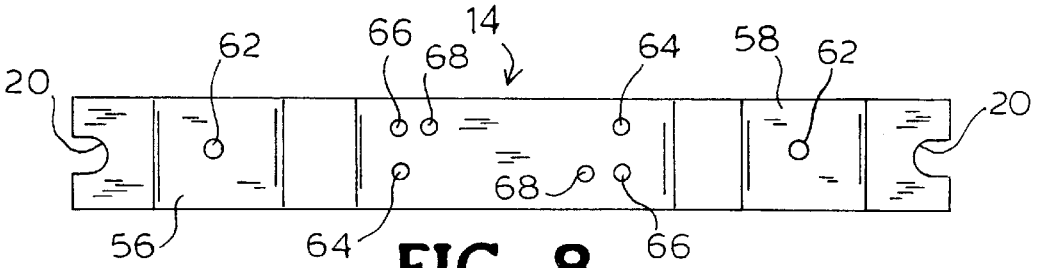
FIG. 8 is a bottom view of the rigid light fixture mounting bracket of the invention shown in FIG. 5.

FIG. 3 shows a perspective view of a light fixture in combination with the support brace (hereinafter referred to as the "first brace member 30") and a traditional transformer mounting bracket (hereinafter referred to as the "second brace member 14"). The first and second brace members 30, 14, respectively, are permanently joined as described below and are hereinafter collectively referred to as the rigid light fixture mounting bracket 32 of the invention. More particularly, FIG. 4 illustrates first brace member 30 fixedly attached to and spanning second brace member 14. First brace member 30 is a rectangular strip of metal having horizontally oriented co-planar longitudinally spaced first and second end portions 34, 36 with top surface 38 and bottom surface 40. A horizontally oriented first middle portion 46 is offset from and the above plane of first and second end portions 34, 36. Between first middle portion 46 and first and second end portions 34, 36, first brace member 30 is bent downwardly from the horizontal plane approximately 45 degrees (angles 42) to cause first brace member 34, 36 to assume a 45° slope and is then bent (angles 44) back to the horizontal plane such that first and second ends 34, 36 are oriented horizontal and parallel to the first middle portion 46 of first brace member 30 to form a bridge-like structure. FIGS. 4 and 5 illustrates second brace member 14 formed of a flat, metallic strip material having a horizontally oriented co-planar longitudinally spaced third and fourth end portions 48, 50. The top surface of third and fourth end portions 48, 50 are immediately adjacent to first and second end portions 34, 36 and are secured by welding or the like to first brace member 30 first and second ends 34, 36 respectively. Between opposed ends 48, 50 of second brace member 14, is a raised pair of horizontally oriented subplatforms 52, 54 offset from and above the plane of said third and fourth end portions 48, 50 and a lowered horizontally oriented second middle platform 56. The top surfaces of subplatforms 52, 54 and of third and fourth end portions 48, 50 are permanently fixed by welding or the like to the bottom surface of the first middle portion 46 of first brace member 30 and first and second end portions 34, 36 respectively to form one rigid light fixture mounting bracket 32 of the invention. Second brace member 14 has recessed ends 20 which align with apertures 60 (shown in FIG. 7) of first brace member 30. Additionally, second brace member 14 has a pair of fastener receiving apertures 62 extending through subplatforms 56, 58 for mounting lower lamp housing 18 to rigid light fixture mounting bracket 32 of the invention. As illustrated in FIGS. 5 and 8, two sets of apertures 64, 66, and 68 extend through the midsection of subplatform 56, and are for mounting light bulb socket 16 (FIG. 3) to rigid light fixture mounting bracket 32 of the invention.

Figure 6:
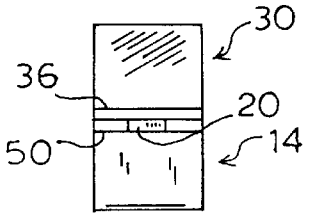
FIG. 6 is an end view of the rigid light fixture mounting bracket of the invention shown in FIG. 5.

The length of the first brace member 30 is coterminous with the length of the second brace member 14. The first brace member 30 and second brace member 14 combination causes the resulting rigid light fixture mounting bracket 32 of the invention to be extremely rigid, preventing undesired bending before, during, or after installation. FIG. 6 further illustrates recessed end 20 of second brace member 14.

The rigid light fixture mounting bracket 32 of the invention is made of a metal material. However, it can be made of any nonmetallic material that is sturdy enough to prevent bending from its desired form before, during, or after installation.

Although the drawings show a conventional transformer mounting bracket with the unique brace of the invention, different shaped first brace members can be designed to work with other shaped second brace members provided that the first brace member of the present invention be formed to substantially bridge the particular second brace member.

While the invention has been described with reference to a specific embodiment thereof, it will be appreciated that numerous variations, modifications, and embodiments are possible, and will become apparent to those skilled in the art. Accordingly, all such variations, modifications, and embodiments are to be regarded as being within the spirit and scope of the invention, and which are intended to be incorporated herein.

What is claimed is:

1. A rigid light fixture mounting bracket for mounting an electrical light fixture assembly having as components thereof a transformer, an upper light fixture housing, a lower lamp housing, and a lamp bulb socket, comprising:

(a) a first brace member formed of a single flat, metallic strip bounded by top and bottom surfaces having:

i) horizontally oriented co-planar and longitudinally spaced first and second end portions; and ii) a horizontally oriented first middle platform portion located between said end portions, offset from and residing in a plane parallel to and above the plane of said first and second end portions and joined thereto;

(b) a second brace member bounded by top and bottom surfaces and formed of a single flat, metallic strip having:

i) horizontally oriented, coplanar, longitudinally third and fourth and portions the top surfaces of said third and fourth end portions being located immediately adjacent and permanently joined to respective bottom surfaces of said fist and second end portions;

ii) a pair of longitudinally spaced, coplanar, horizontal upper platform portions offset from and residing in a plane parallel to and above the plane of said third and fourth end portions, the top surfaces of said upper platform portions being located immediately adjacent to and permanently joined to the bottom surface of said first brace member middle portion;

iii) a horizontally oriented second middle platform portion located between said upper platform portions, offset from and residing in a plane parallel to and below the plane of said upper platform portions and joined thereto; and iv) a pair of horizontally oriented, coplanar longitudinally spaced, lower platform portions offset from and residing in a plane parallel to and below the plane of said upper platform portions and connected thereto;

(c) means effecting said joins wherein said first and second brace members provide an initial rigid brace structure suitable for said mounting;

(d) the top surface of said first brace member first middle platform portion being adapted for being attached to said transformer;

(e) the respective top surfaces of said first and second end portions being adapted for mounting said upper light fixture housing;

(f) the lower platform portions being adapted for mounting said lower lamp housing; and (g) the bottom surface of said second middle platform portion being adapted for mounting said lamp bulb socket.

2. A rigid light fixture mounting bracket as claimed in claim 1 wherein said means for effecting said joins comprises spot welds at the respective locations of said joins.

3. A rigid light fixture mounting bracket as claimed in claim 1 including (i) means for attaching said transformer to the top surface of said first brace member first middle platform portion;

(ii) means for attaching said upper light fixture housing to the respective top surfaces of said first and second end portions;

(iii) means for attaching said lower lamp housing to the said lower platform portions; and (iv) means for attaching said lamp bulb socket to the bottom surface of said second middle platform portion.

4. A rigid light fixture mounting bracket as claimed in claim 1 including:

(i) fastener receiving apertures formed through said first and third end portions where joined;

(ii) fastener receiving apertures formed through said second and fourth end portions where joined;

(iii) fastener receiving apertures formed through said second middle platform; and (iv) fastener receiving apertures formed through each of said lower platform portions.

* * * * *

UNITED STATES PATENT AND TRADEMARK OFFICE

CERTIFICATE OF CORRECTION

PATENT NO. : 5,975,477

DATED : November 2, 1999

INVENTOR(S) : Brian L. Spitler

It is certified that error appears in the above-identified patent and that said Letters Patent is hereby corrected as shown below: Title page,

At Item No. 73 insert --Assignee: Regent Lighting Corporation, Burlington, N.C. --

Column 4, line 29, delete "fist" and replace with --first--

Signed and Sealed this

Sixth Day of June, 2000

*Attest:*

Q. TODD DICKINSON

*Attesting Officer*

*Director of Patents and Trademarks*